US009164483B2

(12) United States Patent
Laesser

(10) Patent No.: US 9,164,483 B2
(45) Date of Patent: Oct. 20, 2015

(54) ESCAPEMENT MECHANISM

(71) Applicant: Olivier Laesser, La Chaux-de-Fonds (CH)

(72) Inventor: Olivier Laesser, La Chaux-de-Fonds (CH)

(73) Assignee: VAUCHER MANUFACTURE FLEURIER S.A., Fleurier (CH)

( * ) Notice: Subject to any disclaimer, the term of this patent is extended or adjusted under 35 U.S.C. 154(b) by 0 days.

(21) Appl. No.: 14/367,383

(22) PCT Filed: Dec. 11, 2012

(86) PCT No.: PCT/EP2012/075118
§ 371 (c)(1),
(2) Date: Jun. 20, 2014

(87) PCT Pub. No.: WO2013/092316
PCT Pub. Date: Jun. 27, 2013

(65) Prior Publication Data

US 2015/0220060 A1 Aug. 6, 2015

(30) Foreign Application Priority Data

Dec. 21, 2011 (EP) ..... 11194941

(51) Int. Cl.
*G04B 15/06* (2006.01)
*G04B 15/14* (2006.01)

(52) U.S. Cl.
CPC ..... *G04B 15/14* (2013.01); *G04B 15/06* (2013.01)

(58) Field of Classification Search
CPC ..... G04B 15/00; G04B 15/06; G04B 15/14; G04B 15/08
USPC ..... 368/127, 131–132
See application file for complete search history.

(56) References Cited

U.S. PATENT DOCUMENTS

| | | | | | |
|---|---|---|---|---|---|
| 22,791 | A | * | 2/1859 | Fasoldt | 368/133 |
| 1,895,666 | A | * | 1/1933 | Junghans | 368/124 |
| 2,907,167 | A | * | 10/1959 | Olsen | 368/125 |
| 3,538,705 | A | * | 11/1970 | Perry | 368/125 |

(Continued)

FOREIGN PATENT DOCUMENTS

| | | | |
|---|---|---|---|
| EP | 1 967 919 | A1 | 9/2008 |
| GB | 682566 | A | 11/1952 |
| GB | 991708 | A | 5/1965 |

OTHER PUBLICATIONS

International Search Report, dated Apr. 2, 2013, from corresponding PCT application.

(Continued)

*Primary Examiner* — Sean Kayes
(74) *Attorney, Agent, or Firm* — Young & Thompson

(57) ABSTRACT

An escapement mechanism for a timepiece, includes an escapement wheel (1), an escapement anchor (2) including a body (2*a*), and a fork (5), the body (2*a*) including pallets (3, 3', 4, 4') that engage with the escapement wheel (1), the body (2*a*) having a shape that makes it possible to delimit an internal space (11) for arranging the escapement wheel (1), the pallets (3, 3', 4, 4') including two rest pallets (3, 3') and two impulse pallets (4, 4'), protruding in the internal space (11). The mechanism includes a pin (7) of a roller (6) that is secured to a regulating device, characterized in that the roller (6) and the fork (5) are arranged with respect to one another such as to impart an alternating translation movement with respect to the escapement wheel (1) to the anchor (2) when the pin (7) engages with the fork (5).

15 Claims, 8 Drawing Sheets

(56) References Cited

U.S. PATENT DOCUMENTS

| | | | | |
|---|---|---|---|---|
| 3,704,582 | A * | 12/1972 | Wuthrich | 368/128 |
| 3,992,954 | A | 11/1976 | Kull | |
| 4,122,665 | A * | 10/1978 | Giger | 368/327 |
| 6,942,378 | B2 * | 9/2005 | Hayek et al. | 368/127 |
| 7,540,654 | B2 * | 6/2009 | Cabezas Jurin et al. | 368/127 |
| 2008/0219104 | A1 | 9/2008 | Jurin et al. | |

OTHER PUBLICATIONS

EP Search Report, dated Aug. 17, 2012, from corresponding EP application.

* cited by examiner

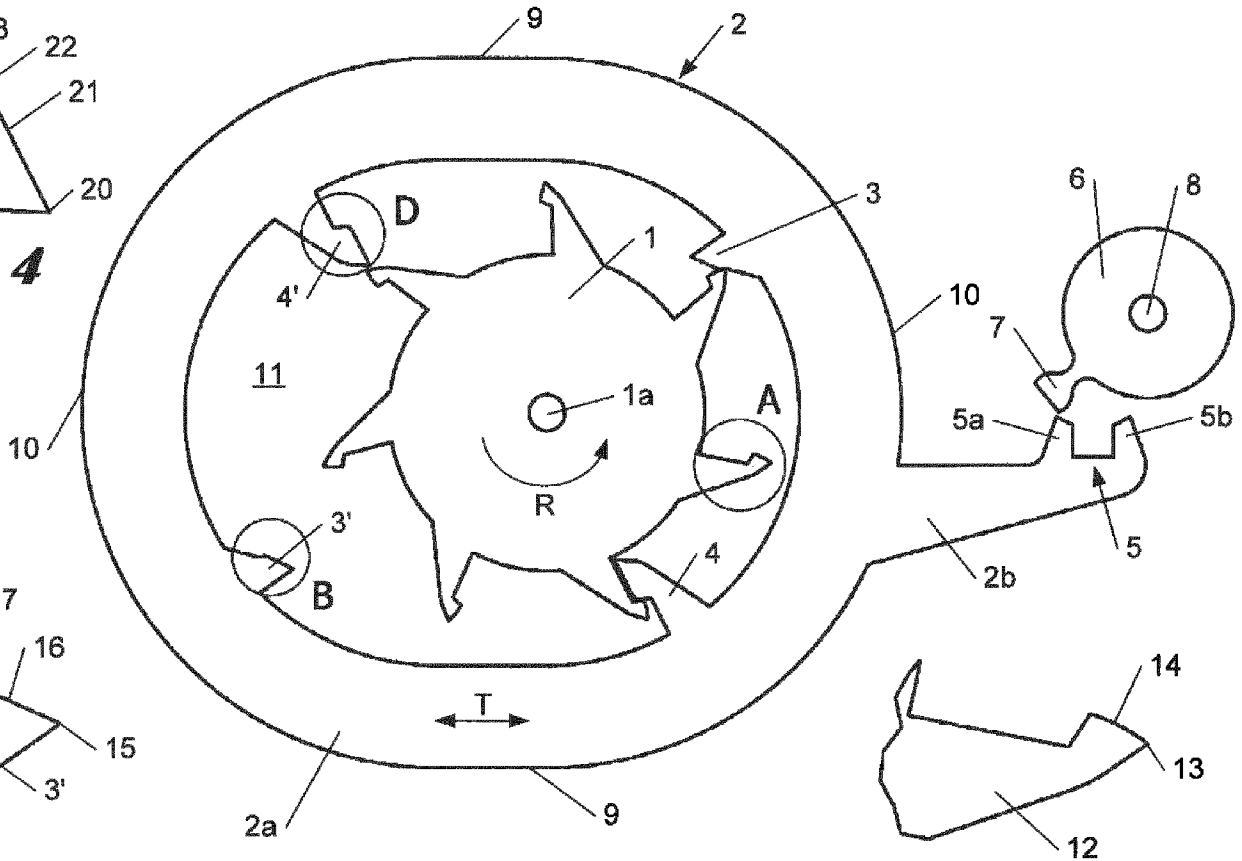
Fig. 1
Fig. 2
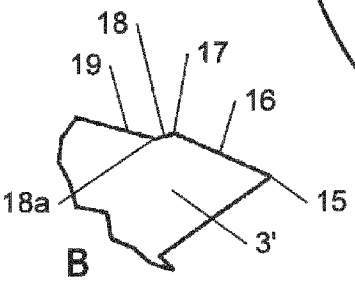
Fig. 3
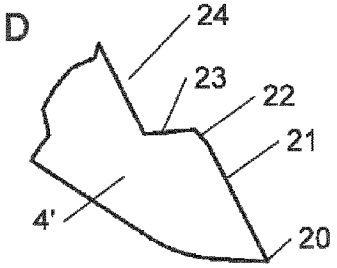
Fig. 4

ESCAPEMENT MECHANISM

TECHNICAL FIELD

The present invention relates to the general technical field of horology, and more particularly the technical field of escapement systems. The invention in particular relates to free escapement systems for mechanical watches, and more generally any system for transferring energy from a disc moving in a single direction to a disc with an alternating movement.

Such an escapement system generally comprises an escape-wheel subject to a quasi-constant torque provided by a barrel and reduced by a gear train. The escapement system also comprises an escapement pallet serving to distribute the energy provided by the escape-wheel in a given direction, alternating in one direction then the other, to a plate. For a mechanical watch, such a plate is secured in rotation to a sprung balance.

BACKGROUND OF THE INVENTION

Escapement systems are known and are consequently not described in detail in this document. These systems include a set of component parts in particular including at least one escape-wheel intended on the one hand to be rotated under the action of at least one drive organ, and on the other hand to cooperate mechanically with at least one regulating organ, to periodically transmit energy to it in order to maintain its oscillations.

Typically, the escape-wheel includes a hub, a felloe provided with teeth and connecting arms rigidly connecting the hub to the felloe.

The most widespread escapement mechanism is the Swiss lever escapement, due in particular to its reliability.

Also known is a pallet escapement by the Melly brothers, the escapement pallet of which includes a stick connecting a body, bearing pallet-stones, to a fork. Such an escapement is for example described in application EP 1,967,919. The stick pivots around a fixed axis parallel to the axis of an escape-wheel. It is widely known that such an escapement does not work properly. In fact, this escapement does not have high operating safety, the transitions between rest, impulse and drop being poorly defined. It is also very bulky and its construction gives it a strong moment of inertia.

BRIEF DESCRIPTION OF THE INVENTION

The present invention aims to provide an improved escapement mechanism, making it possible to increase the efficiency of an escapement system.

Another aim of the present invention is to provide a simple, reliable and compact escapement mechanism.

To that end, and according to the present invention, an escapement mechanism is proposed for a timepiece comprising an escape-wheel, an escapement pallet including a body, a fork secured to said body, said body including pallet-stones intended to cooperate with the escape-wheel, said body having a shape making it possible to delimit an inner space for arranging the escape-wheel, said pallet-stones on the one hand comprising two rest pallet-stones and on the other hand two impulse pallet-stones, protruding in the inner space, said mechanism including a pin of a plate secured to a regulating organ, characterized in that the plate and the fork are arranged relative to one another so as, when the pin cooperates with the fork, to impart an alternating translational movement to the pallet in a direction making it possible to bring the pallet closer to and further away from the regulating organ.

According to one example embodiment of the invention, the translational movement occurs in a direction T perpendicular to the fork opening.

According to one example embodiment of the invention, the plate has an axis of rotation parallel to the axis of rotation of the escape-wheel, such that the pin having an alternating rotational movement cooperates with input and output horns of said fork.

According to one example embodiment of the invention, the impulse pallet-stones and the rest pallet-stones have different shapes.

According to one example embodiment of the invention, the impulse pallet-stones, like the rest pallet-stones, are symmetrical relative to a central axis and normal to the extension plane of the inner space delimited by the body.

According to one example embodiment of the invention, the rest pallet-stones have a shape allowing either so-called "shoulder" positioning of the teeth of the escape-wheel, or positioning by fixed bankings limiting the travel of the pallet.

According to one example embodiment of the invention, each rest pallet-stone has, starting from its free end, an impulse beak, an impulse plane, a rest beak, a rest plane and a return plane.

According to one example embodiment of the invention, each impulse pallet-stone has, starting from the free end, an impulse beak, an impulse plane, a first additional plane and a second additional plane so as to produce a substantially bent shape in a direction opposite the direction of rotation of the escape-wheel.

According to one example embodiment of the invention, each impulse pallet-stone has a countersink extending upstream from its impulse plane, to house the beak and impulse plane of a tooth of the escape-wheel therein without contact.

According to one example embodiment of the invention, the body is a substantially annular part including two substantially rectilinear central parts and one substantially circular portion at the ends of said central parts, thus defining a geometric shape of the inner space having a large axis combined with a direction of translation T passing through the center of the escape-wheel, each of the pallet-stones being arranged in a transition area between a central part and a substantially circular portion.

According to one example embodiment, the escapement mechanism according to the invention makes it possible to implement, via the alternating translational movement of the escapement pallet, repetitive escapement cycles each comprising a rest phase, an unlocking phase, an impulse phase on a rest pallet-stone, a complementary impulse phase on an impulse pallet-stone and a drop phase of the escape-wheel preceding a new rest phase, said phases corresponding to particular positions of the escapement pallet on its translational journey.

According to one example embodiment according to the invention, each tooth of the escape-wheel has, at its free end, a beak acting on the impulse plane of a rest pallet-stone during the impulse phase and an impulse plane acting on the impulse plane of an impulse pallet-stone during the complementary impulse phase.

According to one example embodiment of the invention, during a rest phase, the beak and the impulse plane of a tooth of the escape-wheel are engaged without contact in the countersink of the impulse pallet-stone preceding the rest palette-stone against which another tooth abuts.

According to one example embodiment of the invention, the body, the fork connected to said body by means of a stick, the rest palette-stones and the impulse pallet-stones are connected in a single piece.

According to another example embodiment of the invention, different materials are used to produce parts or elements, for example such as ruby to produce the pallet-stones and steel to produce the body.

According to another preferred example embodiment of the invention, the impulse planes of the impulse pallet-stones are oriented such that the bearing of the teeth is as close as possible to the direction of translation of the pallet.

The present invention also relates to a timepiece including at least one escapement mechanism according to the invention.

The escapement mechanism according to the invention makes it possible to improve the transmission of energy between the escape-wheel and the escapement pallet.

The escapement mechanism according to the invention makes it possible, owing to a decreased number of teeth, to increase the impulse journey while maintaining the drop journey. This results in increasing the transmitted energy proportionally.

The escapement mechanism according to the invention also allows a transmission of energy from the escape-wheel to the pallet through a force whereof the direction is close to that of the direction of movement of the pallet, thereby minimizing energy losses due to friction.

Another advantage of the escapement mechanism according to the invention lies in the fact that it works as safely as a Swiss lever escapement.

Another advantage of the escapement mechanism according to the invention lies in the alternating translational movement in a determined direction of the escapement pallet. This makes it possible to produce the escapement pallet perfectly symmetrically at its palette-stones, which interact with the escape-wheel.

BRIEF DESCRIPTION OF THE DRAWINGS

Other features of the present invention will appear more clearly upon reading the following description, done in reference to the appended drawings, provided as a non-limiting example, in which:

FIG. 1 shows an example embodiment of an escapement mechanism according to the invention in a first rest phase, FIGS. 2, 3 and 4 illustrate enlargements A, B and D of the escapement mechanism of FIG. 1.

DETAILED DESCRIPTION OF THE INVENTION

Figures 5, 6, 7, 8:
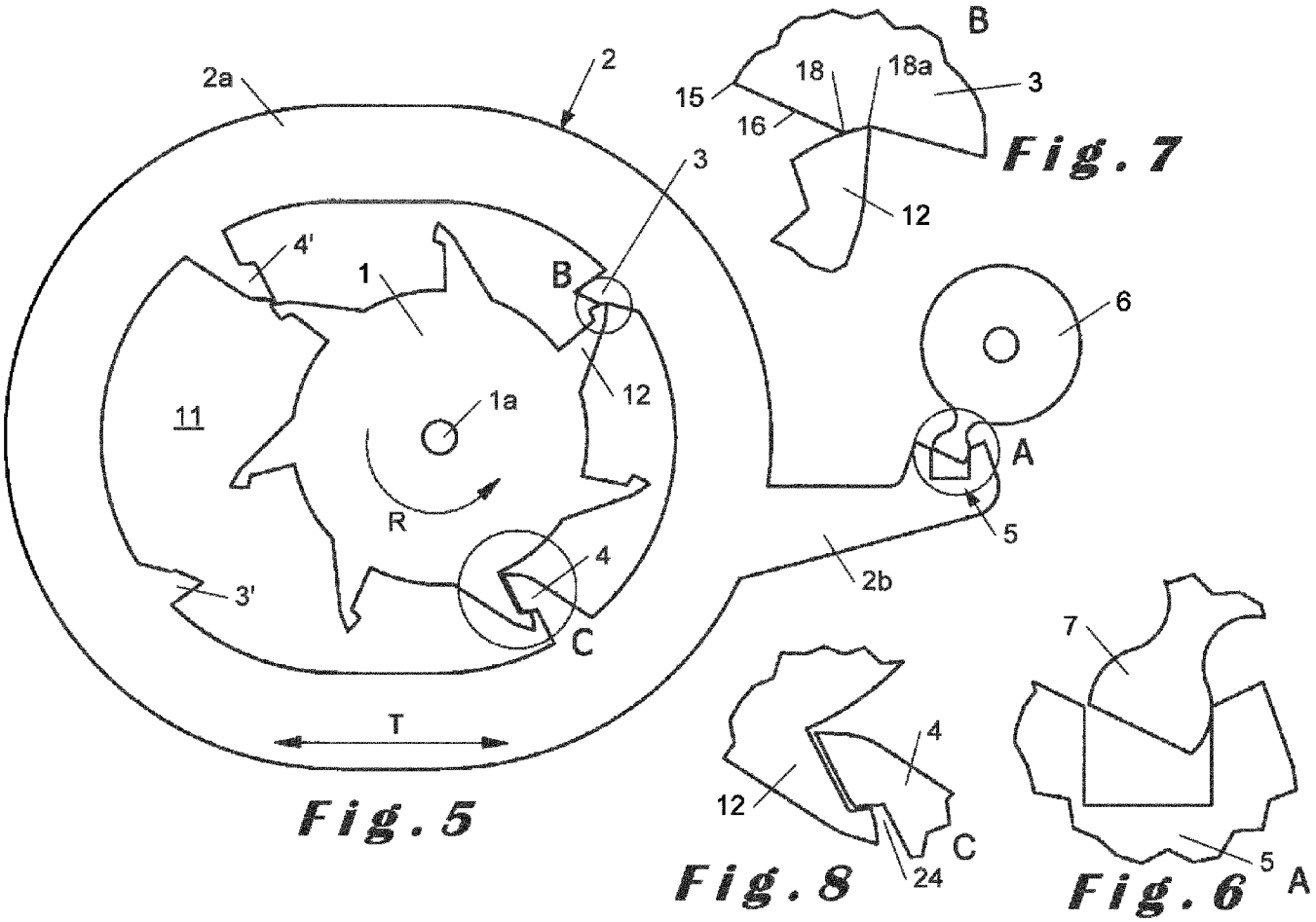
FIG. 5 shows the escapement mechanism according to the invention at the beginning of the unlocking phase.
FIGS. 6, 7 and 8 illustrate enlargements A, B and C of the escapement mechanism of FIG. 5.

Structurally and functionally identical elements that are present in several different figures will be given a same numeric or alphanumeric reference.

FIG. 1 shows an example embodiment of an escapement mechanism according to the invention in a first rest phase. The escapement mechanism comprises an escape-wheel 1 rotating in a direction R around an axis 1*a* and an escapement pallet 2. The escape-wheel 1 advantageously includes an odd number of teeth. That number is for example equal to 7 or 11.

The escapement pallet 2 includes a body 2*a* provided with two rest pallet-stones 3, 3' and two impulse pallet-stones 4, 4'. The escapement pallet 2 also includes a stick 2*b* ending with a fork 5.

The escapement mechanism also comprises a plate 6 provided with a pin 7 at its periphery. The plate 6 pivots following an alternating movement around a pivot axis 8.

As an example, the body 2*a* is a substantially annular piece including two substantially rectilinear central parts 9 and a substantially circular portion 10 at the ends of said central parts, thus defining a geometric shape with an inner space 11 for example having a large axis combined with or parallel to a direction of translation T passing through the center of the escape-wheel 1 and the cooperation zone between the fork 5 and the pin 7.

Each of the rest pallet-stones 3, 3' and each of the impulse pallet-stones are advantageously arranged in a transition zone between a substantially rectilinear central part 9 and a substantially circular portion 10.

According to another example embodiment of the escapement mechanism according to the invention, the impulse pallet-stones are arranged on the substantially rectilinear central parts 9 and the rest pallet-stones are arranged on the substantially circular portions 10.

The body 2*a* has a shape making it possible to the limit the inner space 11 in which the escape-wheel 1 is arranged. The two rest pallet-stones 3, 3' and the two impulse pallet-stones 4, 4' protrude in the inner space 11.

The plate 6 and the fork 5 are arranged relative to one another so as to impart an alternating translational movement in direction T to the escapement pallet 2, when the pin 7 cooperates with the fork 5.

The fork 5 is for example positioned at the end of the stick 2*b* extending substantially in a direction parallel to the direction of translation T. The fork 5 includes input 5*a* and output 5*b* horns extending orthogonally to said direction of translation T.

The pivot axis 8 of the plate 6 is advantageously offset relative to the direction of translation T of the body 2*a* passing through the center 1*a* of the escape-wheel 1. The fork 5 is offset in an opposite direction relative to said direction of translation T of the body 2*a* passing through the center 1*a* of said escape-wheel 1, such that the pin 7 has an alternating rotational movement and cooperates with the input 5*a* and output 5*b* horns.

As an alternative embodiment of the mechanism according to the invention, the fork 5 can be placed on the pallet 2 at any other location. The positioning of the plate 6 would then be adapted accordingly.

The escape-wheel 1 for example includes seven teeth 12, an example embodiment of which is illustrated enlarged in FIG. 2. Each tooth 12 includes an end bent in the direction identical to the direction of rotation R. The bent end has a beak 13 and an impulse plane 14.

The rest pallet-stones 3 and 3', one example embodiment of which is shown enlarged in FIG. 3, each include, starting from the free end, an impulse beak 15, an impulse plane 16, a rest beak 17, a rest plane 18 and a return plane 19.

The impulse pallet-stones 4, 4', one example embodiment of which is shown enlarged in FIG. 4, each include, starting from the free end, an impulse beak 20, an impulse plane 21, a first additional plane 22 and a second additional plane 23 so as to delimit a countersink 24 and to have a substantially bent shape. The impulse pallet-stones 4, 4' are bent in a direction opposite the direction of rotation R of the escape-wheel 1. The first additional plane 22 connects the impulse plane 21 to the second additional plane 23.

As an example, the impulse pallet-stones 4, 4' and the rest pallet-stones 3, 3' therefore advantageously have different shapes.

The impulse planes 16 of the rest pallet-stones 3, 3' are oriented in a preferred direction coming as close as possible to a direction parallel to the direction of translation T. The impulse planes 21 of the impulse pallet-stones 4, 4' are oriented in a preferred direction coming as close as possible to a direction orthogonal to the direction of translation T.

In the rest phase illustrated in FIG. 1, a tooth 12 bears on the rest pallet-stone 3. The return plane 19 and the rest plane 18 are inclined such that the escape-wheel 1 and the escapement pallet 2 are blocked in a stable and precise position in which the beak 13 is positioned at the intersection 18*a* of the rest plane 18 and the return plane 19 of the rest pallet-stone 3. So-called "shoulder" positioning is thus obtained.

In the rest phase, the plate 6, which is secured to a sprung balance, oscillates freely. In this rest phase, another tooth 12 is housed in the countersink 24 of an impulse pallet-stone 4, without being in contact with the escapement pallet 2 at any point.

FIG. 5 shows the escapement mechanism according to the invention at the beginning of the unlocking phase, and FIGS. 6, 7 and 8 illustrate enlargements A, B and C of the escapement system during this beginning of the unlocking phase.

The beginning of the unlocking phase corresponds to the entry of the pin 7 of the plate 6 into the fork 5 of the escapement pallet 2. Reference may for example be made to FIG. 6. The escapement pallet 2 and the escape-wheel 1 are pulled out of the rest position during the unlocking phase. During this unlocking phase, the beak 13 of the tooth 12 works on the rest plane 18 of the rest pallet-stone 3, until it reaches the rest beak 17 of said rest pallet-stone 3.

During the unlocking phase, the sprung balance delivers sufficient energy to counter the torque of the escape-wheel 1 via the escapement pallet 2, by imparting a backward movement to said escape-wheel 1. During this unlocking phase, the other tooth 12 follows the second additional plane 23 of the impulse pallet-stone 4 without touching it.

Figures 9, 10, 11, 12:
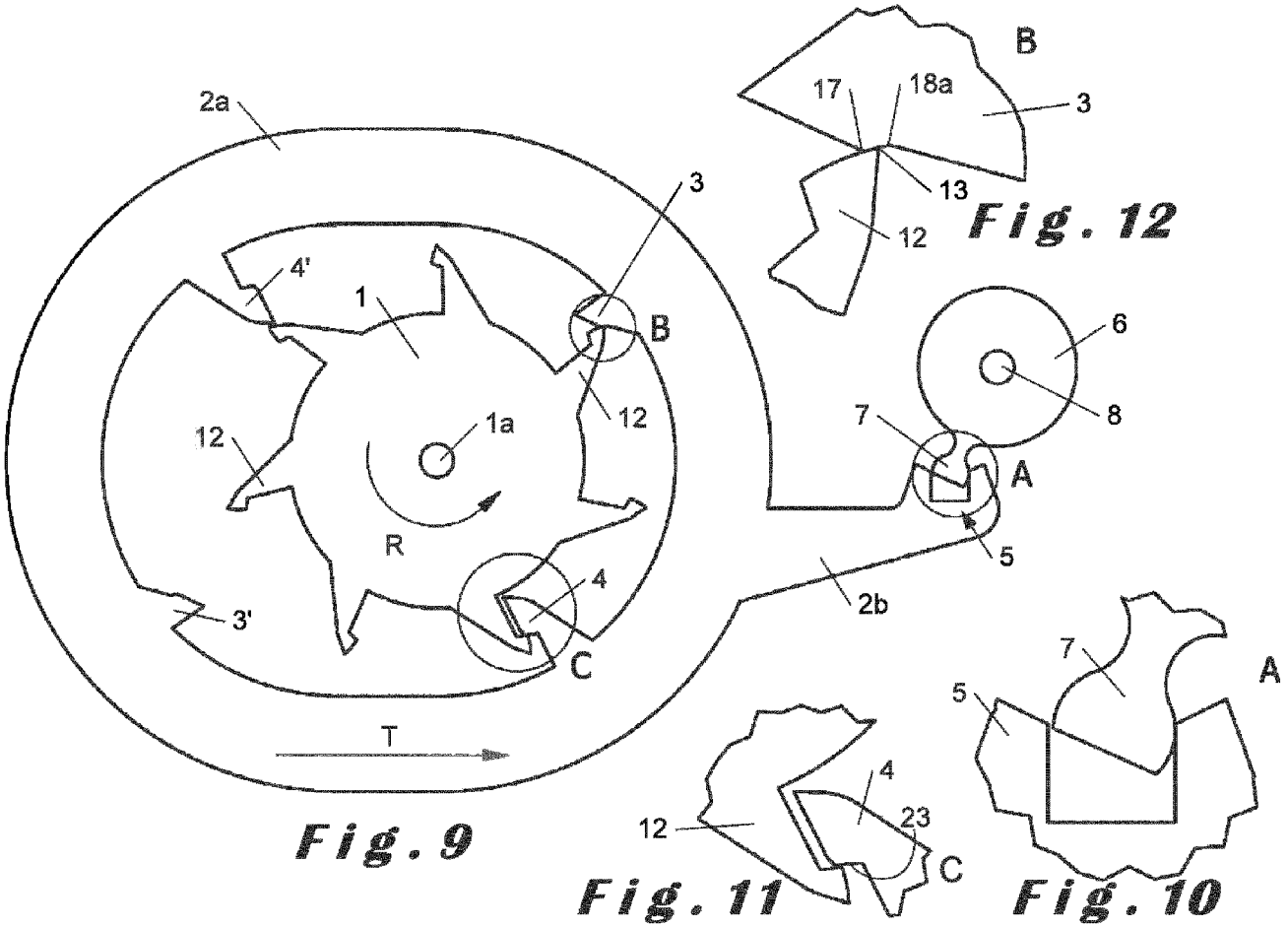
FIG. 9 illustrates the escapement mechanism according to the invention during the unlocking phase.
FIGS. 10, 11 and 12 illustrate enlargements A, B and C of the escapement mechanism of FIG. 9.

FIG. 9 illustrates the escapement system according to the invention during the unlocking phase, and FIGS. 10, 11 and 12 illustrate enlargements A, B and C of the escapement system during that unlocking phase.

Figures 13, 14, 15, 16:
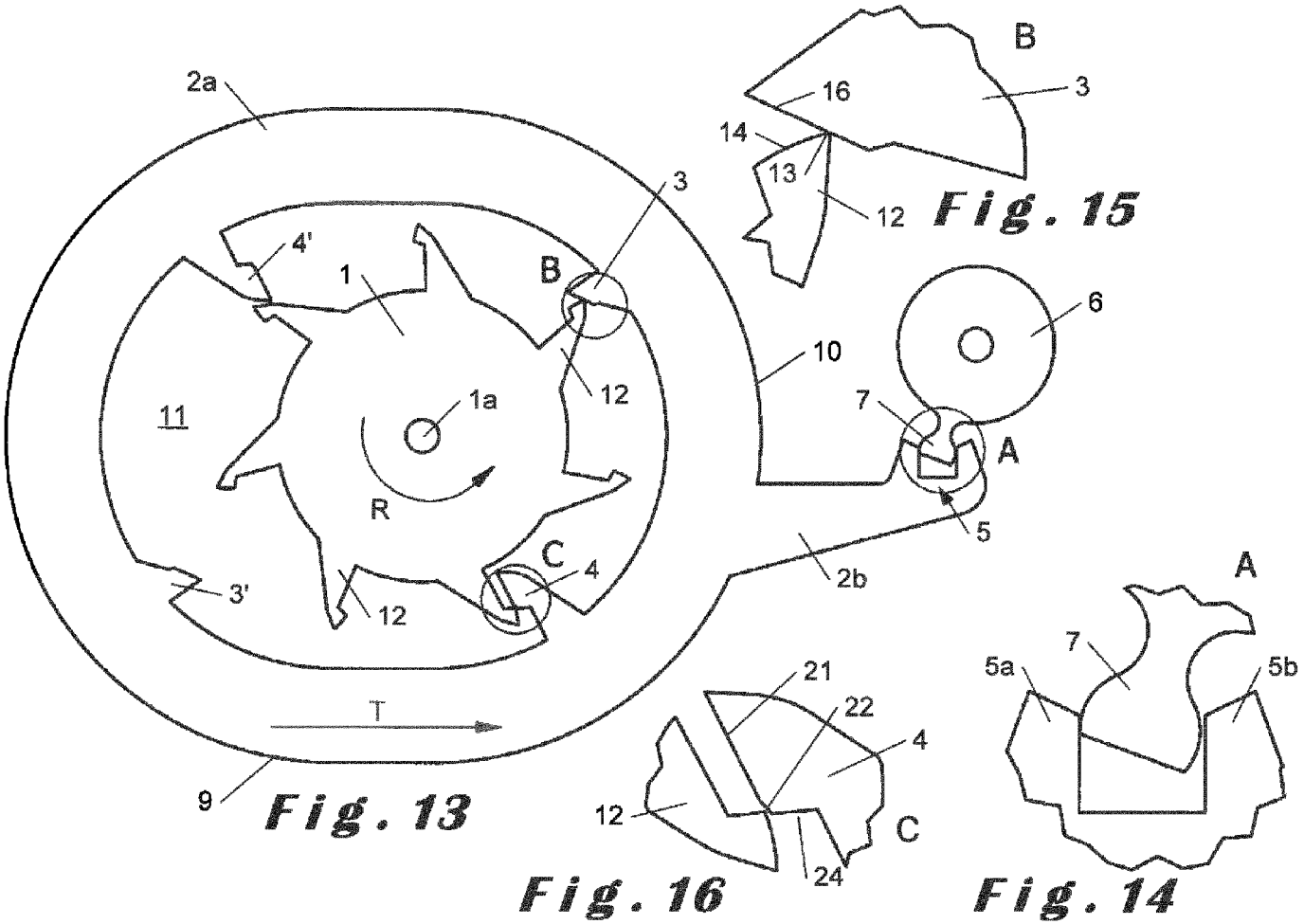
FIG. 13 illustrates the escapement mechanism according to the invention during a first impulse phase.
FIGS. 14, 15 and 16 illustrate enlargements A, B and C of the escapement mechanism of FIG. 13.

FIG. 13 illustrates the escapement system according to the invention during a first impulse phase, and FIGS. 14, 15 and 16 illustrate enlargements A, B and C of the escapement system during that first impulse phase.

Once the beak 13 of the tooth 12 reaches the rest beak 17 of the rest pallet-stone 3, the escape-wheel 1 becomes driving and provides the sprung balance, via the escapement pallet 2 and the plate 6, with the energy necessary to maintain oscillations. This energy is of course greater than that withdrawn during the unlocking phase.

During this first impulse phase, the beak 13 of the tooth 12 acts on the impulse planes 16 of the rest pallet-stone 3. The pressure angle of the tooth 12 on the impulse plane being significant, the impulse journey of said tooth 12 on the rest pallet-stone is minimized, but is sufficient for another tooth 12 to take over on the impulse pallet-stone 4.

During this first impulse phase on the rest pallet-stone 3, the other tooth 12 approaches the impulse pallet-stone 4 along the first additional plane 22 of the impulse pallet-stone 4. Contact is established once the beak 13 of the tooth 12 leaves the rest pallet-stone 3. One then obtains a second impulse phase.

Figures 17, 18, 19:
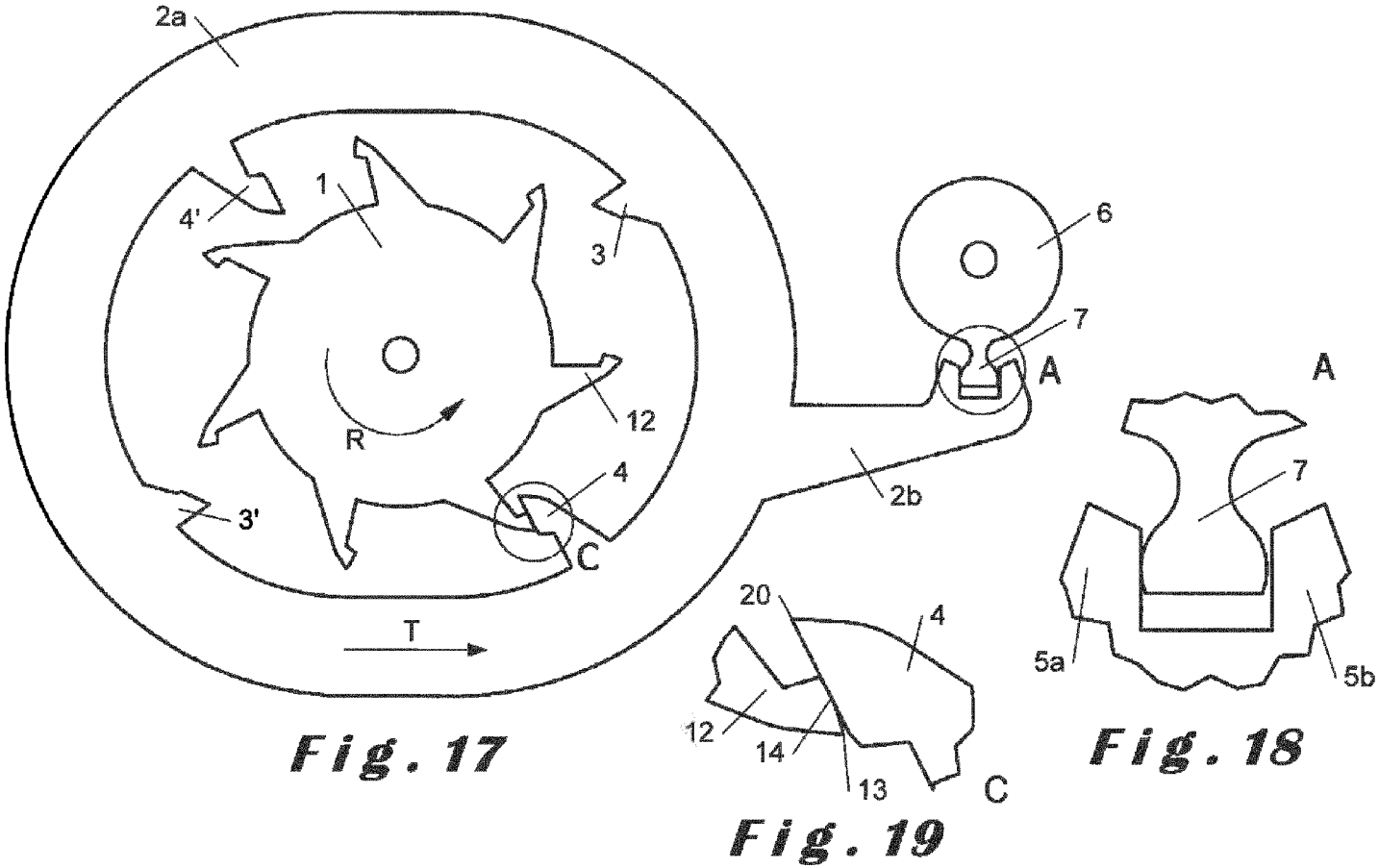
FIG. 17 illustrates the escapement mechanism according to the invention during a second impulse phase.
FIGS. 18 and 19 illustrate enlargements A and C of the escapement mechanism of FIG. 17.

FIG. 17 illustrates the escapement system according to the invention during a second impulse phase, and FIGS. 18 and 19 illustrate enlargements A and C of the escapement system during that second impulse phase.

During this second impulse phase, the impulse is provided by the impulse plane bearing 14 of the other tooth 12 on the impulse plane 21 of the impulse pallet-stone 4. Reference may for example be made to FIG. 19. This bearing takes place until the beak 13 of that other tooth 12 leaves the impulse pallet-stone 4 at its impulse beak 20. FIGS. 17 and 18 also illustrate the cooperation between the pin 7 and the fork 5.

The thrust from the escapement pallet 2 on the sprung balance is then interrupted, and the plate 6 freely continues its movement preceding the next escapement function. This then results in a drop phase, in which the escape-wheel 1, which is momentarily free, finishes its travel with a bearing of another tooth 12 on the other rest pallet-stone 3'. There is then another rest phase.

Figures 20, 21, 22:
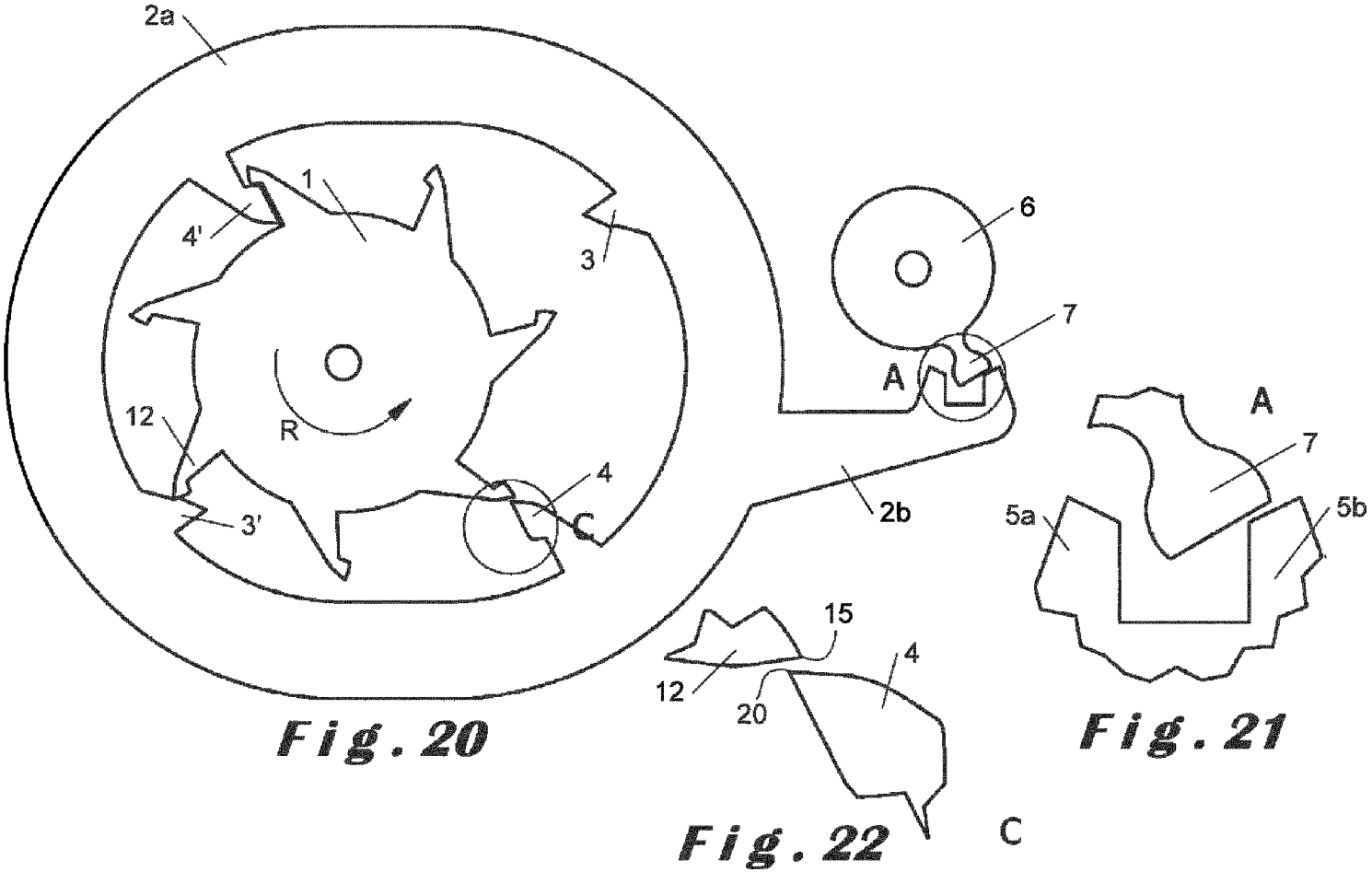
FIG. 20 illustrates the escapement mechanism according to the invention during a second rest phase.
FIGS. 21 and 22 illustrate enlargements A and C of the escapement mechanism of FIG. 20.

FIG. 20 illustrates the escapement mechanism according to the invention during a rest phase, and FIGS. 21 and 22 illustrate enlargements A and C of the escapement system during that second rest phase.

Figure 23:
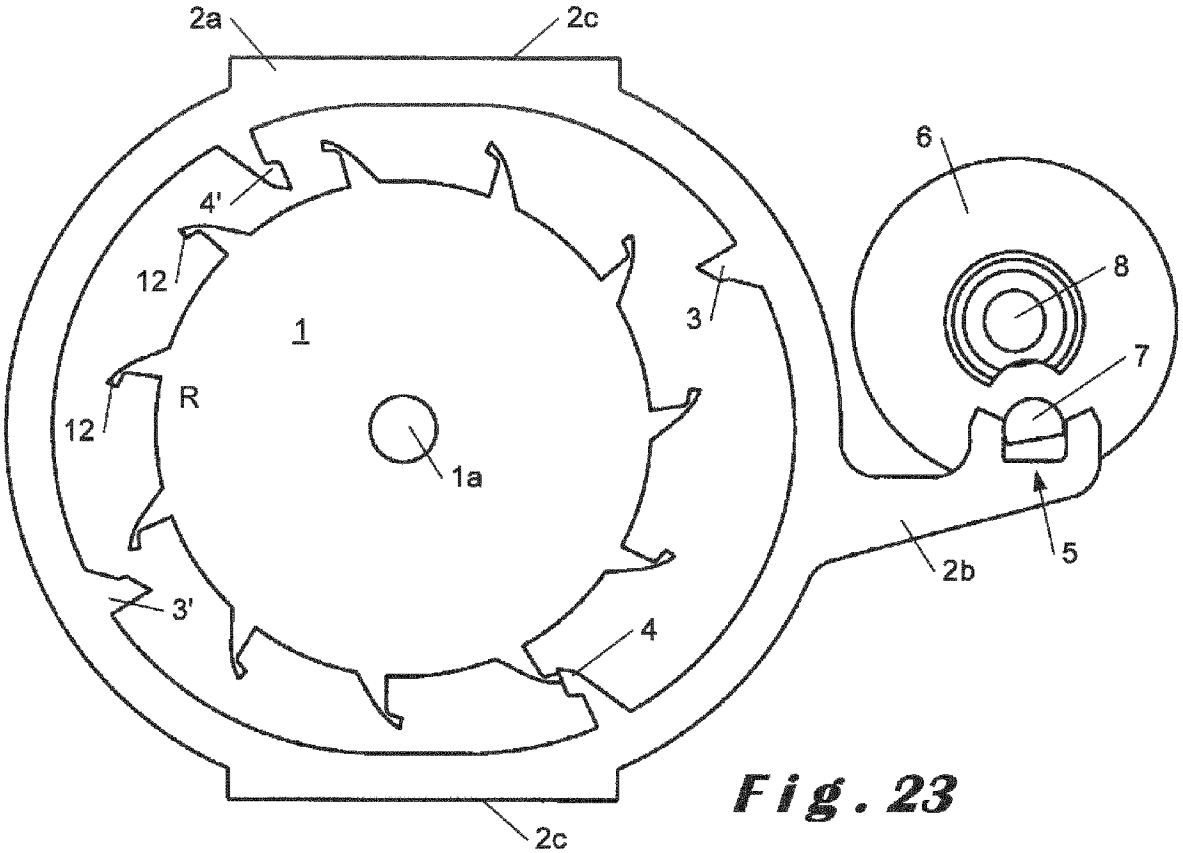
FIG. 23 illustrates another example embodiment of the escapement mechanism according to the invention in the second impulse phase.

FIG. 23 illustrates another example embodiment of the escapement system according to the invention in the second impulse phase. In this example embodiment, the escape-wheel 1 includes eleven teeth 12. The escapement mechanism according to the invention is advantageously integrated into a timepiece, of the bracelet watch or other type.

Furthermore, the body 2*a* has straight sectors 2*c* favoring the guiding and sliding of the escapement pallet 2 on bearing points secured to the frame of a timepiece, box or platen.

The escapement mechanism therefore comprises means for guiding the sliding of the body 2*a*, arranged to cooperate with bearing elements secured to a frame of a timepiece.

The timepiece for example comprises bearing element secured to the frame arranged to cooperate with means for guiding the sliding of the body 2*a* during its alternating translational movements.

Figure 24:
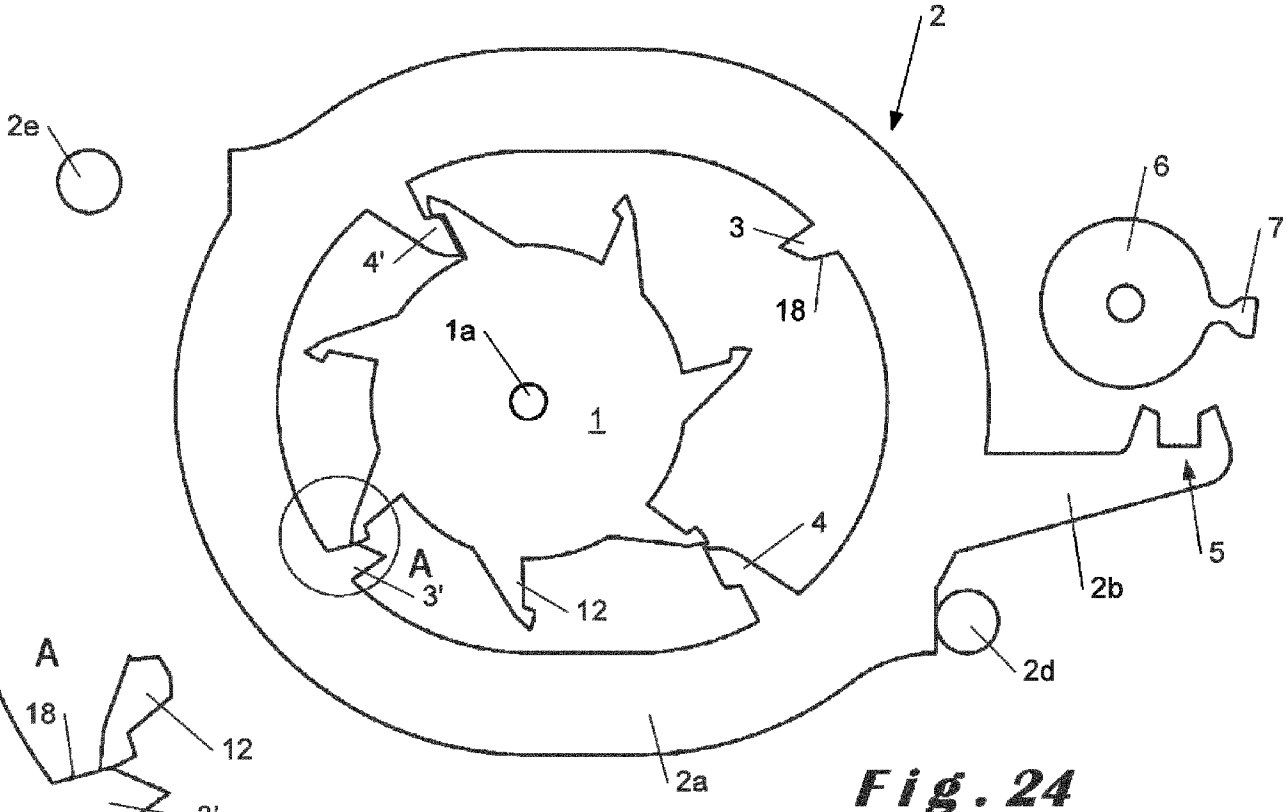
FIG. 24 shows an alternative embodiment of the escapement mechanism according to the invention in the rest phase.
Figure 25:
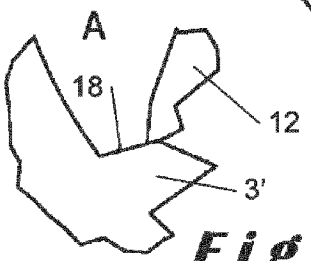
FIG. 25 shows an enlargement A of the escapement mechanism of FIG. 24.

According to another example embodiment of the escapement mechanism according to the invention, illustrated in FIG. 24, the shoulder positioning may be replaced by a positioning method using fixed bankings 2*d* and 2*e* secured to the platen and against which the escapement pallet 2 bears in the rest position. In such an example embodiment, the rest plane 18 would be extended to replace a return plane. The precise positioning of the pallet 2 is then ensured by the bankings 2*d*, 2*e*, and not by the beak 13 positioned at the intersection of a return plane and a rest plane. Reference may for example be made to FIGS. 24 and 25.

According to one preferred example embodiment, the escapement mechanism according to the invention comprises an anti-reversal system. Thus, like a Swiss lever escapement, the fork 5 comprises a dart, not shown, designed to cooperate with a notch of a small plate, not shown, secured to the plate 6.

The present invention is of course not limited to the examples explicitly described, but also comprises other embodiments and/or implementations. A described technical feature may thus be replaced by an equivalent technical feature without going beyond the scope of the present invention.

The invention claimed is:

1. An escapement mechanism for a timepiece comprising an escape-wheel, an escapement pallet including a body, a fork secured to said body, said body including pallet-stones intended to cooperate with the escape-wheel, said body having a shape making it possible to delimit an inner space for arranging the escape-wheel, said pallet-stones on the one hand comprising two rest pallet-stones and on the other hand two impulse pallet-stones, protruding in the inner space, said mechanism including a pin of a plate secured to a regulating organ, wherein the plate and the fork are arranged relative to one another so as, when the pin cooperates with the fork, to impart an alternating translational movement to the escapement pallet in a direction making it possible to bring the escapement pallet closer to and further away from the regulating organ.

2. The escapement mechanism according to claim 1, wherein the translational movement occurs in a direction T perpendicular to the fork opening.

3. The escapement mechanism according to claim 2, wherein the plate has an axis of rotation parallel to the axis of rotation of the escape-wheel, such that the pin having an alternating rotational movement cooperates with input and output horns of said fork.

4. The escapement mechanism according to claim 1, wherein the impulse pallet-stones, like the rest pallet-stones, are symmetrical relative to a central axis and normal to the extension plane of the inner space delimited by the body.

5. The escapement mechanism according to claim 1, wherein the rest pallet-stones have a shape allowing either so-called "shoulder" positioning of the teeth of the escape-wheel, or positioning by fixed bankings limiting the travel of the escapement pallet.

6. The escapement mechanism according to claim 5, wherein each rest pallet-stone has, starting from its free end, an impulse beak, an impulse plane, a rest beak, a rest plane and a return plane.

7. The escapement mechanism according to claim 1, wherein each impulse pallet-stone has, starting from the free end, an impulse beak, an impulse plane, a first additional plane and a second additional plane so as to produce a substantially bent shape in a direction opposite the direction of rotation of the escape-wheel.

8. The escapement mechanism according to claim 7, wherein each impulse pallet-stone has a countersink extending upstream from its impulse plane, to house the beak and the impulse plane of a tooth of the escape-wheel therein without contact.

9. The escapement mechanism according to claim 7, wherein the impulse planes of the impulse pallet-stones are oriented such that the bearing of the teeth is as close as possible to the direction of translation of the escapement pallet.

10. The escapement mechanism according to claim 1, wherein the body is a substantially annular part including two substantially rectilinear central parts and one substantially circular portion at the ends of said central parts, thus defining a geometric shape of the inner space having a large axis combined with a direction of translation T passing through the center of the escape-wheel, each of the pallet-stones being arranged in a transition area between a central part and a substantially circular portion.

11. The escapement mechanism according to claim 1, wherein it makes it possible to implement, via the alternating translational movement of the escapement pallet, repetitive escapement cycles each comprising a rest phase, an unlocking phase, an impulse phase on a rest pallet-stone, a complementary impulse phase on an impulse pallet-stone and a drop phase of the escape-wheel preceding a new rest phase, said phases corresponding to particular positions of the escapement pallet on its translational journey.

12. The escapement mechanism according to claim 11, wherein each tooth of the escape-wheel has, at its free end, a beak acting on the impulse plane of a rest pallet-stone during the impulse phase and an impulse plane acting on the impulse plane of an impulse pallet-stone during the complementary impulse phase.

13. The escapement mechanism according to claim 12, wherein the body is a substantially annular part including two substantially rectilinear central parts and one substantially circular portion at the ends of said central parts, thus defining a geometric shape of the inner space having a large axis combined with a direction of translation T passing through the center of the escape-wheel, each of the pallet-stones being arranged in a transition area between a central part and a substantially circular portion, and wherein during a rest phase, the beak and the impulse plane of a tooth of the escape-wheel are engaged without contact in the countersink of the impulse pallet-stone preceding the rest palette-stone against which another tooth abuts.

14. The escapement mechanism according to claim 1, wherein the body, the fork connected to said body by means of a stick, the rest palette-stones and the impulse pallet-stones are connected in a single piece.

15. A timepiece including at least one escapement mechanism comprising an escape-wheel, an escapement pallet including a body, a fork secured to said body, said body including pallet-stones intended to cooperate with the escape-wheel, said body having a shape making it possible to delimit an inner space for arranging the escape-wheel, said pallet-stones on the one hand comprising two rest pallet-stones and on the other hand two impulse pallet-stones, protruding in the inner space, said mechanism including a pin of a plate secured to a regulating organ, the plate and the fork being arranged relative to one another so as, when the pin cooperates with the fork, to impart an alternating translational movement to the escapement pallet in a direction making it possible to bring the escapement pallet closer to and further away from the regulating organ.

* * * * *